US005921057A

United States Patent [19]

Alderman et al.

[11] Patent Number: 5,921,057

[45] Date of Patent: Jul. 13, 1999

[54] APPARATUS FOR DISPENSING AN INSULATION SUPPORT SHEET FOR USE WITH AN INSULATED ROOF STRUCTURE AND METHOD OF USING SAME

[75] Inventors: Robert J. Alderman, Canyon Lake; James E. Taylor, Seguin, both of Tex.

[73] Assignee: Owens-Corning Fiberglass Technology, Inc., Summit, Ill.

[21] Appl. No.: 09/016,794

[22] Filed: Jan. 30, 1998

[51] Int. Cl.[6] ..... E04D 15/00; B65H 16/02; B65H 57/00

[52] U.S. Cl. ..... 52/746.11; 52/749.1; 52/749.12; 242/566; 242/594.6; 242/615.4

[58] Field of Search ..... 52/749.1, 749.12; 242/557, 566, 594.5, 594.6, 615.2, 615.4

[56] References Cited

U.S. PATENT DOCUMENTS

| | | | |
|---|---|---|---|
| 3,992,847 | 11/1976 | Heath | 52/749.12 X |
| 4,047,345 | 9/1977 | Alderman | 52/404 |
| 4,075,807 | 2/1978 | Alderman | 52/407 |
| 4,222,212 | 9/1980 | Alderman . | |
| 4,967,535 | 11/1990 | Alderman . | |
| 5,551,203 | 9/1996 | Alderman et al. | 52/746.11 |
| 5,653,081 | 8/1997 | Wenrick et al. | 52/749.12 X |
| 5,664,740 | 9/1997 | Alderman et al. | 52/749.12 X |
| 5,685,123 | 11/1997 | Alderman et al. | 52/749.12 X |

*Primary Examiner*—Carl D. Friedman
*Assistant Examiner*—Brian E. Glessner
*Attorney, Agent, or Firm*—Inger H. Eckert; Stephen W. Burns

[57] ABSTRACT

An apparatus for providing a roof structure of the type having a plurality of purlins spaced apart from one another in a parallel arrangement is disclosed. The purlins have a generally vertical portion. The space between the vertical portions of adjacent purlins defines an insulation cavity which is generally rectangular in cross-sectional shape. The apparatus includes a carriage which is movable along the length of the purlins for dispensing a support sheet from a roll for support of insulation material. As the carriage travels along the length of the purlins, the support sheet is dispensed so that the support sheet depends from the top portion of adjacent purlins. The apparatus further includes a first bar having a curvilinear shape which is mounted on the carriage and extends across the width of the support sheet. The first bar is positioned so that the support sheet contacts and is guided by the first bar as the support sheet is dispensed. A second bar having a curvilinear shape is mounted on the carriage and extends across the width of the support sheet. The second bar is positioned so that the support sheet contacts and is guided by the second bar as the support sheet is dispensed. The curvilinear shapes of the first and second bars modify the cross-sectional shape of the support sheet to substantially conform to the shape of the insulation cavity as the support sheet is dispensed.

20 Claims, 4 Drawing Sheets

APPARATUS FOR DISPENSING AN INSULATION SUPPORT SHEET FOR USE WITH AN INSULATED ROOF STRUCTURE AND METHOD OF USING SAME

TECHNICAL FIELD AND INDUSTRIAL APPLICABILITY OF THE INVENTION

This invention relates to the construction of an insulated metal roof structure for use in commercial and industrial buildings.

BACKGROUND OF THE INVENTION

Metal roof structures typically comprise a series of parallel rafter beams extending across the building in one direction and purlin beams parallel to each other mounted on top of the rafters extending in a direction normal to the rafters. Insulation material in long sheets is placed in the area between purlins. The sheets of insulation material can be laid along the length of the purlins or across the purlins in a direction normal to the purlins. If desired, the roof structure can have a first layer of insulation material which is laid along the length of the purlins, and a second layer of insulation material which is laid laterally across the purlins on top of the first layer of insulation. Hard roofing material such as metal decking is then attached on top of the purlins over the insulation material. Because the hard roofing material comes in long sheets and the roofs generally have two sloped sections, it is customary to construct the roof along the length of the structure from one end to the other. The workers stand on the previously laid section of roof to construct the next section.

The insulation material is supported between the purlins beneath the hard roofing material. Various methods of supporting the insulation material have been used. Mounting straps or wire mesh which are attached to or draped over the purlins forming a lattice have been used. This is referred to as banding. A sheet, typically made of vinyl and acting as a vapor barrier, is then rolled onto the lattice, and insulation material is placed between adjacent purlins and over the sheet. If the installation of the lattice is done from underneath the roof structure, scaffolding or lifting equipment is typically required for installation. Since the lattice encompasses the entire roof, installation is costly and time consuming. Once the hard roofing material is mounted on the purlins, the sheet can support the insulation material and the lattice no longer serves any useful purpose.

Some systems dispense with the lattice and use the sheet itself to support the insulation material. The support sheet is dispensed from a roll and draped from adjacent purlins. Insulation material is then placed on top of the support sheet. A carriage has been used to aid in the dispensing of the support sheet, such as that disclosed in U.S. Pat. No. 4,967,535 to Alderman. The carriage is positioned on top of the purlins and travels the length of the purlins during the roof construction. A roll of the support sheet material is mounted on the carriage and the support sheet is dispensed from the roll and placed on top of the purlins. As the carriage travels the length of the purlins, the support sheet is draped across the purlins. However, the support sheet can sag between the purlins resulting in a small or limited vertical height at the sides of the insulation cavity adjacent to the purlins, and this results in a compression of the insulation material in that area.

An additional step to compensate for the small vertical height when draping the insulation material is to use clips to hold the support sheet onto the purlin to reduce sagging.

Clips that are attached to the bottom of the purlins require installation from underneath the roof structure and typically require scaffolding or lifting equipment. Clips that are installed over the purlins and extend the support sheet downward are known in the art but require the workers to lean over the edge of the previously laid section of roof and attach the clip to the purlin. Because of the increased costs due to the expense of the installation and the clips themselves, the use of clips is undesirable.

Various members or guides have been used to prevent the sagging of the support sheet and increase the vertical height at the sides of the insulation cavity adjacent to the purlins, such as that disclosed in U.S. Pat. No. 4,222,212 to Alderman. The guides are mounted on the carriage and extend downward below the top of the purlins and on top of the sheet. The guides are positioned near the purlins so that the sides of the sheet extend downward along the vertical portions of the purlins to create a generally rectangular cross-sectional area into which the insulation material can be placed. Since the distance from the roll of sheet material to the guides is a relatively short distance due to the relatively short length of the carriage, the dispensed sheet can tear while the guides attempt to forcefully reposition the sheet in such a short distance. Also, because the guides must force the sheet downward, the longitudinal edges of the sheet can be misaligned with the tops of the purlins. The edges of the sheet must then be re-aligned so that when the hard roofing material is attached to the tops of the purlins, the sheet supports the insulation. This misalignment also exposes the edges of the sheet, thereby creating an undesirable appearance when the roof structure is viewed from below.

U.S. Pat. No. 5,653,081 to Wenrick, et al. discloses a method of constructing a roof structure using a folded facing sheet which unfolds into an insulation cavity. This method works very well, but does utilize a specially folded facing sheet that generally can be more expensive.

It would be desirable to have a system of building a roof structure which is inexpensive and simple to construct and which does not require the use of lattice straps, clips, or utilize a specially folded facing roll, yet provides for in insulation support system which enables the full thickness of the insulation blanket to be used.

SUMMARY OF THE INVENTION

The above objects as well as other objects not specifically enumerated are achieved by an improved apparatus for providing a roof structure and a method of using the same, in which a support sheet is directed through a plurality of curvilinear shaped guide bars for modifying the shape of the support sheet to conform to the shape of an insulation cavity between adjacent purlins. The apparatus and method provides for an inexpensive and simple system with which to construct a roof structure.

The present invention provides for a roof structure of the type having a plurality of purlins spaced apart from one another in a parallel arrangement is disclosed. The purlins have a generally vertical portion. The space between the vertical portions of adjacent purlins defines an insulation cavity which is generally rectangular in cross-sectional shape. The improved apparatus includes a carriage which is movable along the length of the purlins for dispensing a support sheet from a roll for support of insulation material. As the carriage travels along the length of the purlins, the support sheet is dispensed so that the support sheet depends from the top portion of adjacent purlins. The apparatus further includes a first guide bar having a curvilinear shape which is mounted on the carriage and extends across the width of the support sheet. The first guide bar is positioned so that the support sheet contacts and is guided by the first guide bar as the support sheet is dispensed. A second guide bar having a curvilinear shape is mounted on the carriage and extends across the width of the support sheet. The second guide bar is positioned so that the support sheet contacts and is guided by the second guide bar as the support sheet is dispensed. Preferably, the curvilinear shape of the second guide bar more closely conforms to the cross-sectional shape of the insulation cavity than the curvilinear shape of the first guide bar. The curvilinear shapes of the first and second guide bars modify the cross-sectional shape of the support sheet to conform to the shape of the insulation cavity as the support sheet is dispensed.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 1:
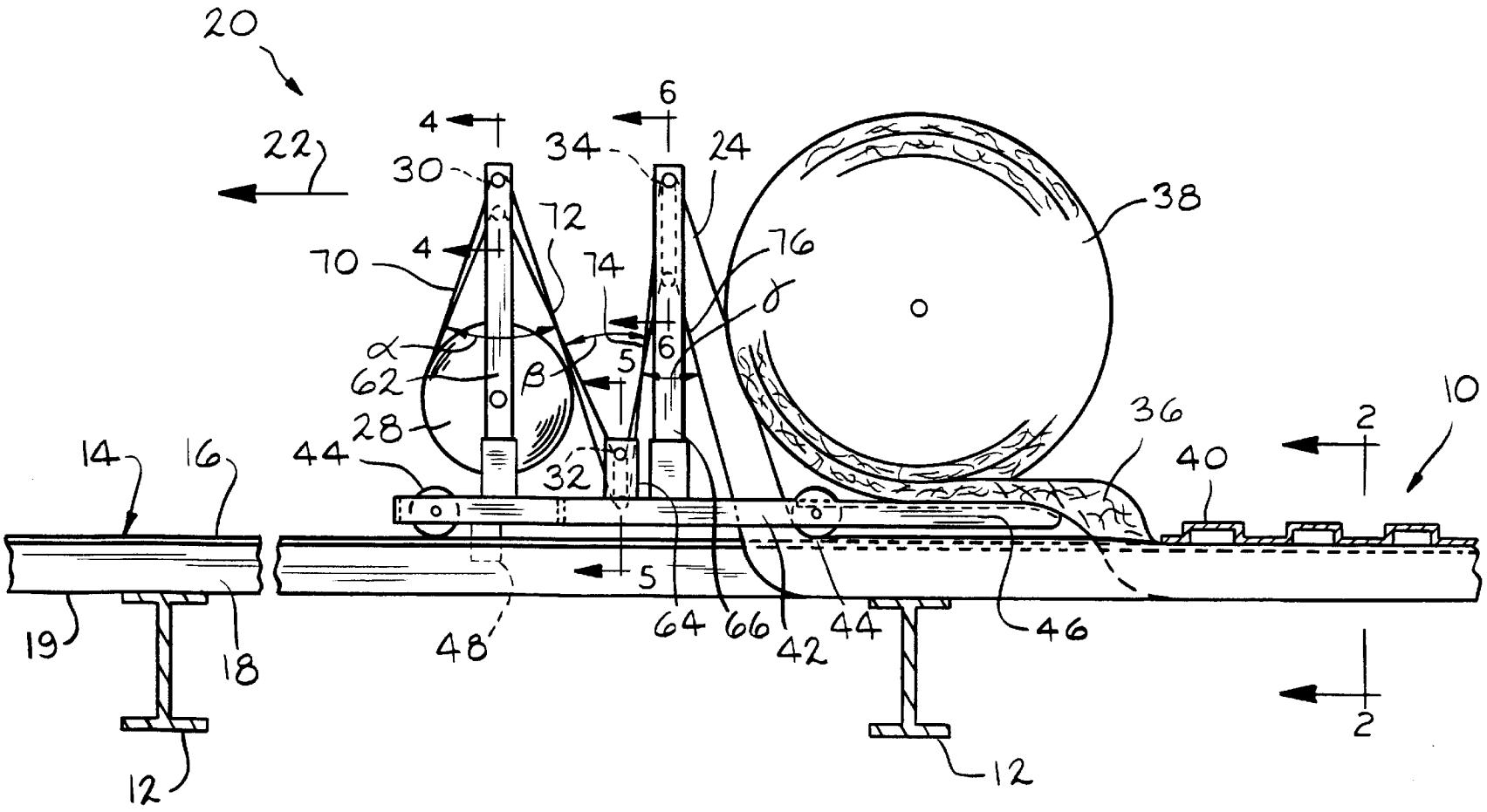
FIG. 1 is a schematic side elevational view of a carriage for providing a roof structure according to the present invention.
Figure 2:
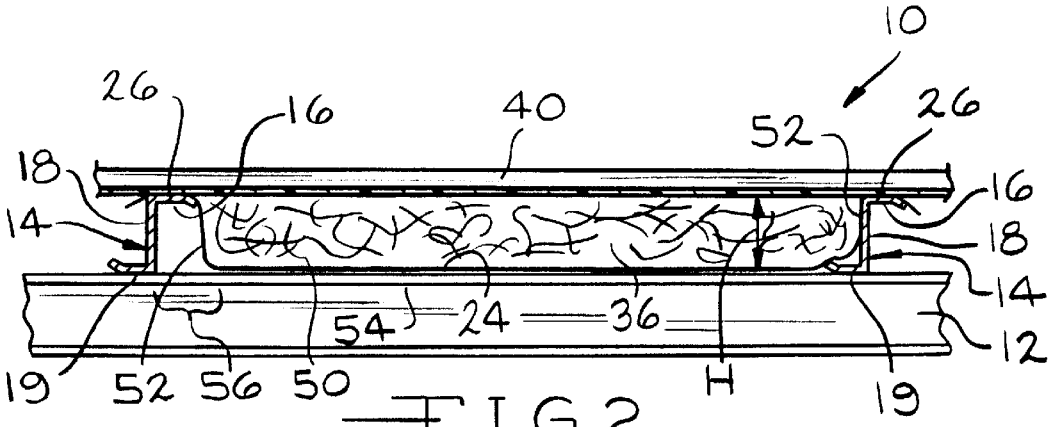
FIG. 2 is a sectional view taken along Line 2—2 of FIG. 1 illustrating a completed section of the insulated roof structure.

Referring to FIGS. 1 and 2, there is illustrated an insulated building roof structure, indicated generally at 10. The roof structure is supported by main rafter beams 12 which are positioned parallel to each other. A plurality of purlins 14, spaced apart and arranged parallel to each other, are fastened on top of the rafters in a direction perpendicular to the rafters. The spacing of the purlins is typically 5 feet (1.52 m) on centers. As shown in FIG. 2, the illustrated purlins have a generally Z-shaped cross-section and include a top portion 16, a vertical portion 18, and a bottom portion 19. Roof structures may also be constructed from bar joists, or trusses, and the invention as described herein will work equally well with purlins, bar joists or trusses. The use of the term "purlins" in this specification and claims includes not only traditional purlins, but also joists, trusses, and other similar structural members.

Broadly stated, the roof structure is constructed by use of a carriage, indicated generally at 20, which rides on the top portion of the purlins and travels along the length of the purlins in a downstream direction, represented by an arrow 22. As the carriage is moved, a support sheet 24 having longitudinal edges 26, as shown in FIG. 2, is dispensed from a roll 28. As will be explained in detail below, the support sheet is guided around first, second, and third curvilinear shaped guide bars 30, 32, and 34, respectively. The guide bars 30, 32, and 34 turn the direction of the support sheet as the support sheet is dispensed from the roll. The support sheet is eventually draped on top of adjacent purlins so that the support sheet depends from the top portions 16 of adjacent purlins. The support sheet supports a layer of insulation material 36 which is placed on top of the support sheet between the adjacent purlins. The insulation material is typically dispensed from a roll 38 placed on the carriage but can be applied by any suitable manner, such as by applying insulation batts on top of the support sheet. Alternatively, a layer of insulation may be placed laterally across the purlins. After the insulation material has been placed on the support sheet, long sheets of hard roofing material 40, such as metal roof decking, are then attached to the top portion 16 of the purlins 14 over the support sheet and insulation. The hard roofing material can be fastened to the purlins in any suitable manner, such as by threaded fasteners or clips. The attachment of the hard roofing material presses down on the longitudinal edges 26 of the support sheet which are sandwiched between the top portions of the purlins and the hard roofing material, so that the support sheet supports the insulation between the purlins.

Because the hard roofing material usually comes in long sheets, typically 30 to 35 feet (9.1 to 10.7 m), and the roofs generally have two sloped sections, it is customary to construct a first section of the roof structure along the width of the sloped section and then proceed along the length of the structure from one end to the other. The workers stand on the previously attached section of the roof structure to assemble the next section of roof. The carriage travels along the length of the purlins and is moved by the workers as each new section of roof is assembled. The carriage can be moved in the downstream direction 22 by any suitable manner, such as by being pushed by the workers, or pulled by means of a winch and a cable.

Although the carriage is described as extending between only two adjacent purlins, the carriage can be any length up to the width of the roof itself. Preferably, the carriage is comprised of a plurality of carriage sections joined together so that they span the entire width of the sloped section of the roof. The carriage sections are then propelled in unison along the purlins so that all the carriage sections move as a unit. Because the longitudinal edges 26 of the support sheet are draped across the top portion of adjacent purlins, the total width of the support sheet is wider than the distance between the centers of the purlins. Therefore, adjacent rolls of support sheet can be positioned in a staggered manner such that they are not co-linear with each other. Preferably, a carriage section covers two purlin spans, i.e., about 10 feet (3.3 m) in length. For example, each carriage section can have both a leading roll and a trailing roll of support sheet positioned in a staggered manner from one another, one roll for each of two adjacent purlin spans. A longitudinal edge of the support sheet from the trailing roll will be draped on top of a longitudinal edge of the support sheet from the leading roll as the carriage moves in the downstream direction. Multiple identical carriage sections, each having a leading and trailing roll, can therefore, be joined together, with every roll being staggered from an adjacent roll.

The carriage 20 can any suitable apparatus which moves along the top of the purlins and dispenses the support sheet in a manner in accordance with the present invention. In the illustrated embodiment of FIG. 1, the carriage includes a horizontally extending body 42. Preferably, the carriage has rollers 44 rotatably mounted on the body for rolling along the top portions 16 of the purlins 14 for ease of movement. The body also includes an extension 46 which provides support for the roll 38 of insulation material 36. The carriage may also include guides 48 which extend downwardly from the carriage and extend below the top portions of the purlins. The guides 48 prevent the carriage from moving in a lateral direction with respect to the purlins so that the carriage travels accurately along the length of the purlins and the longitudinal edges of the support sheet are dispensed evenly across the respective top portions of the purlins.

Figure 3:
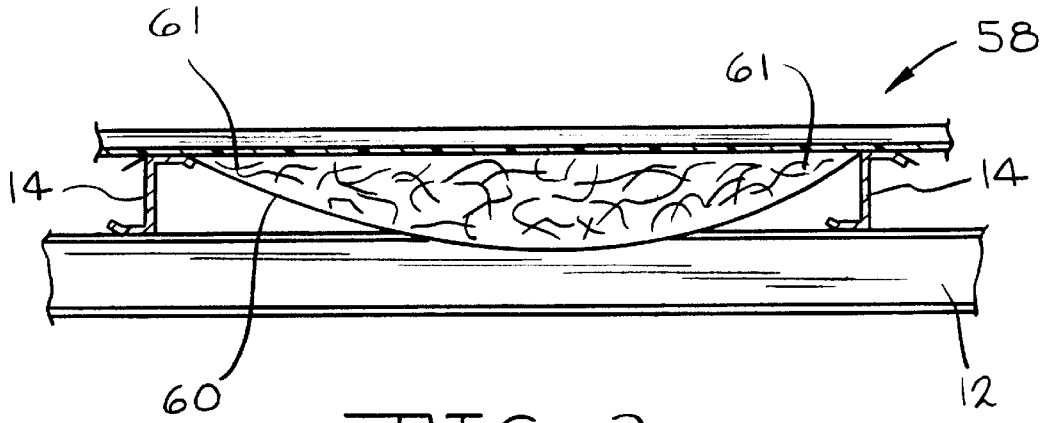
FIG. 3 ( PRIOR ART )
FIG. 3 is a sectional view of a completed prior art insulated roof structure.

The space between the vertical portions 18 of adjacent purlins 14 generally defines an insulation cavity 50, as seen in FIG. 2. The insulation cavity has a generally rectangular cross-sectional shape. It is advantageous to fill out the insulation cavity uniformly with the insulation material without leaving relatively large gaps, thereby maximizing the insulating qualities of the roof structure. Thus, the support sheet 24 is preferably draped between adjacent purlins so that the support sheet substantially conforms to the generally rectangular shape of the insulation cavity. For example, as shown in FIG. 2, the support sheet 24 has generally vertically extending side portions 52 and a generally horizontally extending central portion 54 which generally conform to the shape of the insulation cavity. Although a slight gap 56 exists directly underneath the top portion 16 of the left-hand purlin, the support sheet still is considered to conform to the shape of the insulation cavity 50. Also, the side portions 52 of the support sheet 24 do not have to extend all the way to the bottom portions 19 of the purlins 14. For example, if the height of the purlin was about 9 inches (22.9 cm), it may be desirable to only place insulation material having a height of about 4 inches (10.2 cm). Thus, the side portions 52 of the support sheet need only to be about 4 inches high to accommodate the height of the insulation material. In contrast, there is shown in FIG. 3, a prior art roof structure, indicated generally at 58 The roof structure 58 includes a support sheet 60 having a shape which does not conform to the generally rectangular insulation cavity. The support sheet 60 has a generally V-shaped cross-section such that insulation material is compressed at sides 61 of the insulation cavity when the sheets of hard roofing material 40 are fastened to the purlins. The compression of the insulation material at the sides 61 reduces the insulation area and lowers the overall thermal value of the roof structure.

The purpose of the support sheet is to support the insulation material in the insulation cavity, but the support sheet can also be used as a vapor barrier, and for aesthetic purposes. The support sheet can be of any suitable material for the stated purposes, such as vinyl or foil faced paper.

The carriage 20 further includes a pair of vertically extending posts 62 which support the roll 28 of support sheet 24 and the first guide bar 30. A pair of vertically extending posts 64 support the second guide bar 32. A pair of vertically extending posts 66 support the third guide bar 34.

Figure 4:
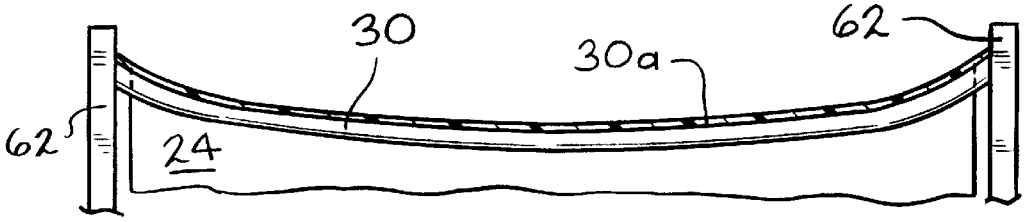
FIG. 4 is a partial sectional view taken along Line 4—4 of FIG. 1 illustrating the shape of a first guide bar.
Figure 5:
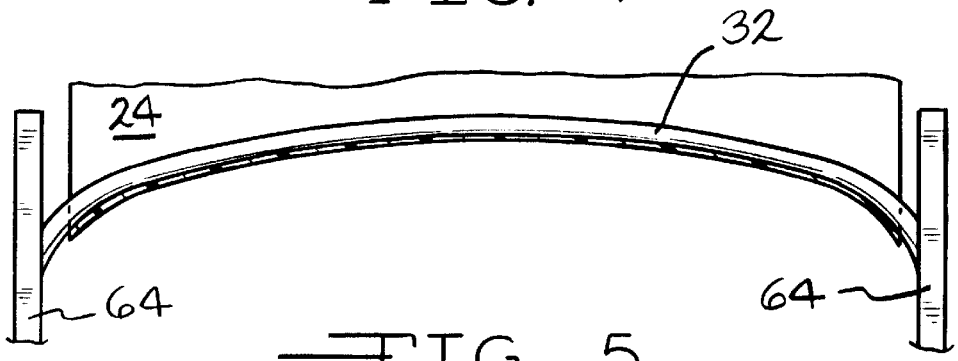
FIG. 5 is a partial sectional view taken along Line 5—5 of FIG. 1 illustrating the shape of a second guide bar.
Figure 6:
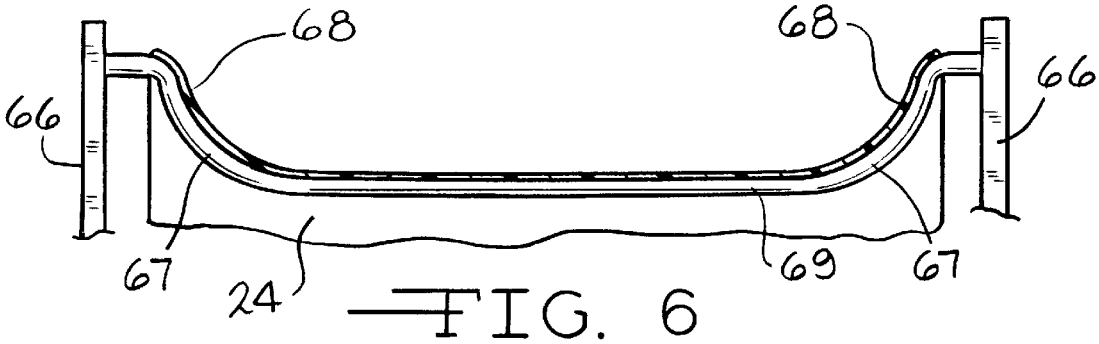
FIG. 6 is a partial sectional view taken along Line 6—6 of FIG. 1 illustrating the shape of a third guide bar.

As stated before, the support sheet 24 contacts and is guided around the guide bars 30, 32, and 34. The profile or cross-sectional shape of the support sheet as it is immediately dispensed from the roll 28, is typically linear in shape, i.e., in a straight line. The guide bars help modify the cross-sectional shape of the support sheet from the linear or straight line cross-sectional shape to a shape which more closely conforms to the generally rectangular cross-section of the insulation cavity 50, such as an elongated U-shape. Preferably, the shape of the guide bars progressively changes so that each subsequent guide bar has a shape which more closely conforms to the generally rectangular cross-section of the insulation when compared to the preceding guide bar. For example, as shown in FIG. 4, the first guide bar 30 has a relatively gradual generally arcuate shape which modifies the cross-sectional shape of the support sheet to be more curvilinear. As shown in FIG. 5, the second guide bar 32 has a generally arcuate shape having a shorter radius than the first guide bar 30 resulting in an even steeper or sharper curved shape. As shown in FIG. 6, the third guide bar 34 more closely conforms to the shape of the insulation cavity in that the third guide bar has end portions 67 which are curved to a generally vertical orientation. The end portions 67 modify the longitudinal sides 68 of the support sheet 24 to even more closely conform to a generally vertical orientation, as is shown in FIG. 6. Although the third bar 34 is illustrated as having a generally linear shaped central portion 69, the central portion can be curved.

It should further be understood that the width of the sheet on the roll 28 is normally wider than the width of the cavity 50, and, as the sheet progresses across the bars 30, 32, and 34 its width in a direction parallel to the top surfaces of the purlins 14 is gradually reduced to be roughly equivalent to the width of the cavity 50 plus the width of two purlins 14.

It is generally desirable to dispense the support sheet so that support sheet has longitudinal tension. The tension provides support of the insulation material placed on top of the support sheet. Because the support sheet has a generally planar shape as it is dispensed from the roll, it is difficult to provide longitudinal tension while permitting the longitudinal sides 68 of the support sheet to be positioned vertically, due to lateral tension of the support sheet. The guide bars of the present invention, enable the support sheet to have longitudinal tension while allowing the longitudinal sides 68 of the support sheet to be generally positioned vertically so that the support sheet conforms to the insulation cavity. The tension also helps to create a aesthetically pleasant uniform appearance of the support sheet as viewed from below.

Preferably, the portions of the guide bars which contact the support sheet are concave to the support sheet. For example, as shown in FIG. 4, the guide bar 30 has a concave surface **30*a* which contacts the support sheet 24, as shown in cross-section, as the support sheet travels partially around the guide bar 30. Thus, as the direction of the support sheet is turned by the guide bar 30, the concave surface 30*a* modifies the profile or cross-sectional shape of the support sheet. It should be understood that the guide bars 30, 32, and 34** can have contacting surfaces having any suitable shape, such as linear or convex.

Although the illustrated carriage of FIG. 1 is shown having three guide bars, the carriage can have any number of guide bars which are suitable to modify the cross-sectional shape of the support sheet to conform to the shape of the insulation cavity. In the illustrated embodiment of the carriage 20 in FIG. 1, the support sheet is directed around the guide bars 30, 32, and 34 so that the cross-sectional shape of the support sheet is modified to conform to the shape of the insulation cavity 50 having a height H, as shown in FIG. 2. If, for example, it is desired to place insulation material having a height which is less than H above the support sheet, the support sheet can be draped across the purlins to form an insulation cavity having a height less than the height H. The support sheet can then be directed around only a couple of guide bars having shapes which correspond to the height desired. For example, the support sheet could be directed so that after contacting and being turned by the second guide bar 32, the longitudinal edges 26 of the support sheet are positioned above the top portions 16 of the purlins 14, thereby bypassing the third guide bar 34. The second guide bar 32 can then be oriented to curve downward instead of upward, as shown in FIG. 5.

Another advantage of directing the support sheet around multiple guide bars is that the travel length during which the support sheet is modified from a planar shape immediately leaving the roll 28 to a shape which conforms to the shape of the generally rectangular insulation cavity, can be increased. It is difficult to modify the cross-section of the support sheet if the travel length of the support sheet from the roll to the completed section of the roof structure is relatively short. By positioning the placement of the guide bars, the travel length of the support sheet can be increased while maintaining a relatively small carriage length. For example, as shown in FIG. 1, the first guide bar 30 is positioned above the roll 28 of support sheet so that the support sheet is directed upward. The second and third guide bars 32 and 34 are positioned so that after departing from the first guide bar, the support sheet is directed in a zigzag or multi-directional manner when viewed from the side. As shown in FIG. 1, the axes of the roll 28, the first guide bar 30, and the second guide bar 32 are positioned in a generally triangular arrangement. Thus, a portion 70 of the support sheet approaching the first guide bar and a portion 72 of the support sheet departing from the first guide bar forms an angle $\alpha$. The angle $\alpha$ is preferably less than about 90 degrees so that the length of the carriage can be relatively small compared to the multi-directional travel length of the support sheet directed around the first, second, and third guide bars. Preferably, the first, second, and third guide bars are also positioned so that the portion 72 and a portion 74 of the support sheet forms an angle $\beta$. The angle $\beta$ is preferably less than about 90 degrees so that the length of the carriage can be relatively small compared to the multi-directional travel length of the support sheet directed around the first, second, and third guide bars. Similarly, the second guide bar, the third guide bar, and the roller 44 could be positioned so that a the portion 74 and a portion 76 of the support sheet forms an angle $\gamma$ which is preferably less than about 90 degrees.

Figure 7:
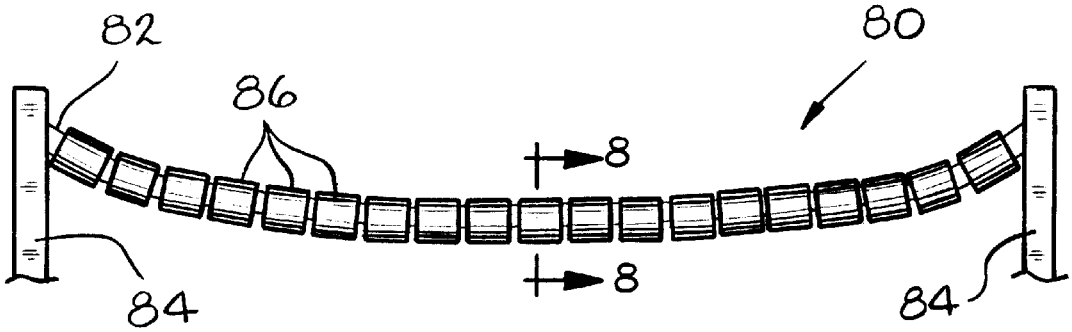
FIG. 7 is an elevational view of a first alternate embodiment of a guide bar having a plurality of rollers positioned about a stationary bar.
Figure 8:
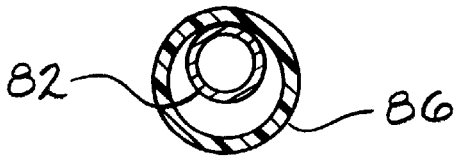
FIG. 8 is a sectional view taken along Line 8—8 of FIG. 7.

There is illustrated in FIGS. 7 and 8 a first alternate embodiment of a guide bar assembly 80, which can be used, for example, in place of any one or more of the first, second, or third guide bars 30, 32, or 34, respectively, of the carriage 20 of FIG. 1. The guide bar assembly 80 includes a bar 82 having a curvilinear shape which is supported by vertically extending posts 84 mounted on a carriage (not shown). Rotatably disposed around the bar 82 are a plurality of rollers, such as tubes 86. As the support sheet is directed across the guide bar assembly 80, the tubes 86 are in rolling engagement with the support sheet to assist in reducing the frictional contact between the guide bar and the support sheet. The tubes 86 can be made of any suitable material, such as plastic. Although in the illustrated embodiment the rollers are tubular in shape, any suitable roller mechanism can be used, such as bushings or bearings.

Figure 9:
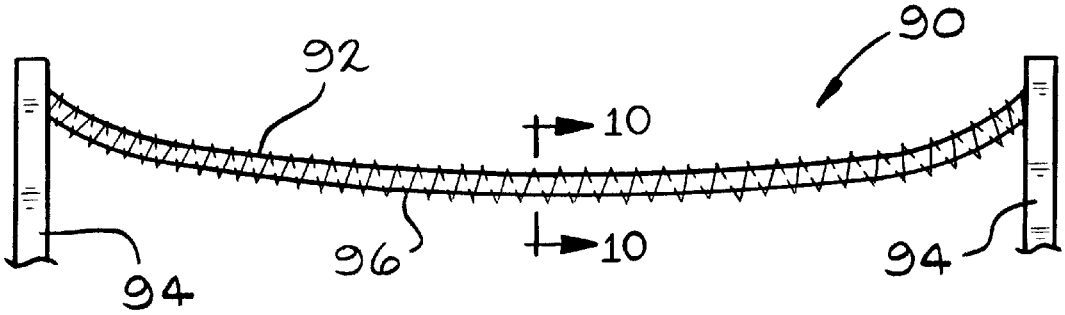
FIG. 9 is an elevational view of a second alternate embodiment of a guide bar having a rotatable coil positioned about a stationary bar.
Figure 10:
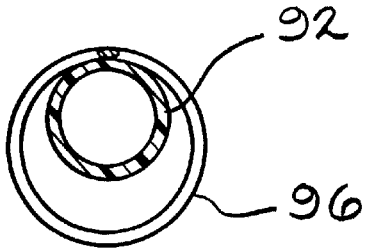
FIG. 10 is a sectional view taken along Line 10—10 of FIG. 9.

There is illustrated in FIGS. 9 and 10, a second alternate embodiment of a guide bar assembly 90, which can be used, for example, in place of any one or more of the first, second, or third guide bars 30, 32, or 34, respectively, of the carriage 20 of FIG. 1. The guide bar assembly 90 includes a bar 92 having a curvilinear shape which is supported by vertically extending posts 94 mounted on a carriage (not shown). Rotatably disposed around the bar 92 is a helical coil 96 wrapped around the bar 92. As the support sheet is directed across the guide bar assembly 90, the coil 96 is in rolling engagement with the support sheet to assist in reducing the frictional contact between the guide bar and the support sheet. The coil is preferably flexible enough to conform to the curvilinear shape of the bar 92.

The principle and mode of operation of this invention have been described in its preferred embodiments. However, it should be noted that this invention may be practiced otherwise than as specifically illustrated and described without departing from its scope.

What is claimed is:

1. An apparatus for providing a roof structure of the type having a plurality of purlins spaced apart from one another in a parallel arrangement, the purlins having a generally vertical portion, the space between the vertical portions of adjacent purlins defining an insulation cavity which is generally rectangular in cross-sectional shape, the apparatus comprising:

a carriage movable along the length of the purlins for dispensing a support sheet from a roll for support of insulation material as the carriage travels along the length of the purlins so that the support sheet depends from the top portion of adjacent purlins; and a first bar mounted on the carriage and extending across the width of the support sheet, the first bar having a first curvilinear shape, the first bar being positioned so that the support sheet contacts and is guided by the first bar as the support sheet is dispensed from the roll; and a second bar mounted on the carriage and extending across this width of the support sheet, the second bar having a second curvilinear shape, the second bar being positioned so that the support sheet contacts and is guided by the second bar after contacting the first bar, wherein the first curvilinear shape of the first bar and the second curvilinear shape of the second bar modify the cross-sectional shape of the support sheet to substantially conform to the shape of the insulation cavity.

2. The apparatus of claim 1, wherein the second curvilinear shape of the second bar has a smaller radius of curvature than the first curvilinear shape of the first bar.

3. The apparatus of claim 1 further including a third bar mounted on the carriage and extending across the width of the support sheet, the third bar having a third curvilinear shape, the third bar being positioned so that the support sheet contacts and is guided by the third bar as the support sheet is dispensed.

4. The apparatus of claim 3, wherein the third curvilinear shape of the third bar has at least one section having a smaller radius of curvature than the second curvilinear shape of the second bar.

5. The apparatus of claim 1, wherein the support sheet is rolled onto the roll such that the support sheet has a generally linear cross-section as the support sheet is dispensed.

6. The apparatus of claim 1, wherein the first curvilinear shape of the first bar is generally arcuate in shape.

7. The apparatus of claim 1, wherein the portion of the first bar which contacts the support sheet has a concave curvilinear shape with respect to the support sheet.

8. The apparatus of claim 1, wherein the portion of the first bar which contacts the support sheet has a convex curvilinear shape with respect to the support sheet.

9. The apparatus of claim 1, wherein the first bar is positioned above the roll in a direction generally away from the carriage.

10. The apparatus of claim 1, wherein the roll, the first bar, and the second bar are positioned such that the portion of the support sheet approaching the first bar and the portion of the support sheet departing from the first bar as the support sheet is dispensed generally form an angle less than about 90 degrees.

11. The apparatus of claim 1, wherein the first and second bars have rollers which are in rolling contact with the support sheet as the support sheet is dispensed.

12. The apparatus of claim 11, wherein the rollers are tubular.

13. The apparatus of claim 11, wherein the rollers are formed by coils wrapped around the first and second bars.

14. An apparatus for providing a roof structure of the type having a plurality of purlins spaced apart from one another in a parallel arrangement, the purlins having a generally vertical portion, the space between the vertical portions of adjacent purlins defining an insulation cavity which is generally rectangular in cross-sectional shape, the apparatus comprising:

a carriage movable along the length of the purlins for dispensing a support sheet from a roll for support of insulation material as the carriage travels along the length of the purlins so that the support sheet depends from the top portion of adjacent purlins; and a first bar mounted on the carriage and extending across the width of the support sheet, the first bar having a first curvilinear shape, the first bar being positioned so that the support sheet contacts and is guided by the first bar as the support sheet is dispensed from the roll; and a second bar mounted on the carriage and extending across the width of the support sheet, the second bar having a second curvilinear shape, the second bar being positioned so that the support sheet contacts and is guided by the second bar after contacting the first bar; and a third bar mounted on the carriage and extending across the width of the support sheet, the third bar having a third curvilinear shape, the third bar being positioned so that the support sheet contacts and is guided by the third bar after contacting the second bar, wherein the first, second, and third curvilinear shapes of the first, second, and third bars, respectively, modify the cross-sectional shape of the support sheet to substantially conform to the shape of the insulation cavity.

15. The apparatus of claim 14, wherein the second curvilinear shape of the second bar has a smaller radius of curvature than the first curvilinear shape of the first bar, and the third curvilinear shape of the third bar has at least one section having a smaller radius of curvature than the second curvilinear shape of the second bar.

16. A method for providing a roof structure having a plurality of purlins spaced apart from one another in a parallel arrangement, the purlins having a generally vertical portion, the space between the vertical portions of adjacent purlins defining an insulation cavity which is generally rectangular in cross-sectional shape, the method comprising the steps of:

a. providing a carriage having a roll of insulation support sheet mounted thereon, the carriage further including first and second bars mounted on the carriage and extending in a direction generally perpendicular to the purlins, wherein the first bar has a first curvilinear shape, and the second bar has a second curvilinear shape;

b. moving the carriage along the length of the purlins such that the support sheet is dispensed from the roll for support of insulation material so that the support sheet depends from the top portion of adjacent purlins; and c. guiding the support sheet as the support sheet is dispensed so that the support sheet contacts and is guided by the first bar and subsequently contacts and is guided by the second bar, thereby modifying the cross-sectional shape of the support sheet to substantially conform to the shape of the insulation cavity as the support sheet is dispensed.

17. The method of claim 1, wherein the support sheet is subsequently guided by a third bar having a third curvilinear shape and which is mounted on the carriage such that the support sheet contacts and is guided by the third bar as the support sheet is dispensed, thereby modifying the cross-sectional shape of the support sheet to substantially conform to the shape of the insulation cavity.

18. The method of claim 16, wherein the roll, the first bar, and the second bar are positioned such that the support sheet is guided so that a portion of the support sheet approaching the first bar and the portion of the support sheet departing from the first bar as the support sheet is dispensed generally forms an angle less than about 90 degrees.

19. The method of claim 16, wherein the support sheet is guided from the roll in a generally upward direction away from the purlins and towards the first bar.

20. The method of claim 19, wherein the support sheet subsequently guided from the first bar in a generally downward direction away from the first bar towards the second bar.

* * * * *